United States Patent [19]

Vandeputte et al.

[11] 3,995,298

[45] Nov. 30, 1976

[54] APPARATUS FOR PROCESSING PHOTOGRAPHIC FILM AND RECOVERING SOLID SUBSTANCES FROM THE PROCESSING SOLUTIONS USED

[75] Inventors: Camille Angelina Vandeputte, Mortsel; Marcel Robert Fierens, Duffel; Marcel Frans Aelterman, Mortsel, all of Belgium

[73] Assignee: AGFA-GEVAERT N.V., Mortsel, Belgium

[22] Filed: Nov. 6, 1974

[21] Appl. No.: 521,499

[30] Foreign Application Priority Data

Nov. 7, 1973 United Kingdom ..... 51641/73

[52] U.S. Cl. ..... 354/324; 159/7; 159/DIG. 1; 159/DIG. 6

[51] Int. Cl.[2] ..... G03D 3/02

[58] Field of Search ..... 354/297, 299, 319, 320, 354/321, 322, 324; 159/2 E, 12, 16 R, DIG. 1, DIG. 6, DIG. 28, 7

[56] References Cited

UNITED STATES PATENTS

| | | | |
|---|---|---|---|
| 2,873,799 | 2/1959 | Earley et al. | 159/DIG. 6 |
| 3,241,981 | 3/1966 | Strashun et al. | 159/12 UX |
| 3,269,920 | 8/1966 | Merrill | 159/DIG. 28 |
| 3,533,829 | 10/1970 | Quanquin | 159/16 R |
| 3,604,331 | 9/1971 | Carberry et al. | 354/324 |
| 3,653,424 | 4/1972 | Carlsson | 159/16 R |
| 3,733,994 | 5/1973 | Armstrong et al. | 354/324 X |

*Primary Examiner*—Fred L. Braun
*Attorney, Agent, or Firm*—William J. Daniel

[57] ABSTRACT

An apparatus of small dimensions may be used to operate the water contained in the processing baths of automatic processing machines. The solid residue may be collected and sent to silver recovery plants, whereas the evaporated water serves to heat the drying station of the processing machine whereinafter it may be fed to the washing station. In so doing, a considerable amount of wash water is recovered and no chemical compounds are discharged to the sewer through which pollution of surface waters is practically eliminated.

11 Claims, 4 Drawing Figures

Figure 1:
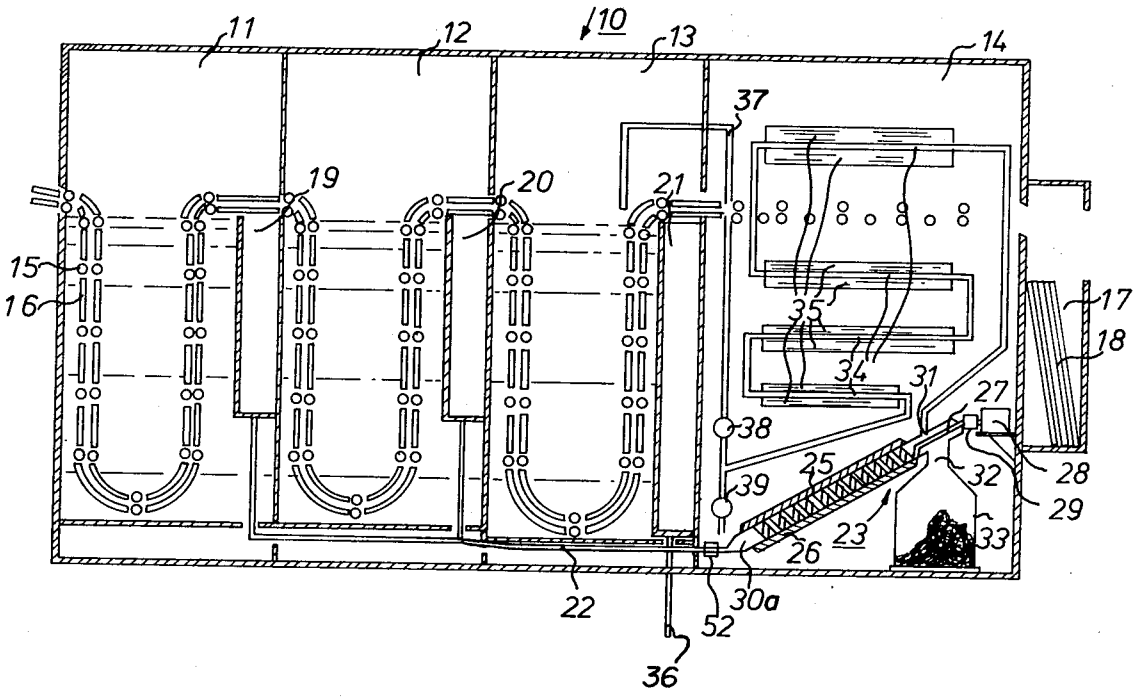

APPARATUS FOR PROCESSING PHOTOGRAPHIC FILM AND RECOVERING SOLID SUBSTANCES FROM THE PROCESSING SOLUTIONS USED

This invention relates to an apparatus for processing photographic material. More particularly, it is concerned with apparatus for silver recovery from used processing baths which enables the user either to limit the unnecessary spoiling of wash water and/or to avoid or at least considerably to reduce the amount of high-polluting solutions to be discharge to waste.

In the automatic processing of silver halide photographic materials, the materials are usually conducted through successive processing stations where there are baths of the requisite processing liquids. The photographic material may for example be conducted through developing, fixing and washing stations. Known processing machines are generally constructed in such a way that the liquid overflow from the mixing station, being rich in soluble silver complexes, is collected and submitted to a silver recovery system either in an electrolytic way, or with the help of a kind of absorption column, in which metallic wool is present (metallic replacement method), whereinafter the residue of the fixing liquid is poured into the sewer. As to the liquid overflow of the developing tank, no special precautions are taken in order to eliminate or at least to reduce the polluting properties of the latter.

Modern processing machines, moreover, consume large quantities of wash water, which contain very complex chemical compounds at low concentrations and would therefore require special treatment in order that they can be added to surface waters without risk of polluting them.

It is an object of the invention to provide an apparatus wherein used processing solution(s) is or are treated in a convenient way in order to separate silver compounds from the water. A secondary object of the invention which is realised by preferred embodiments of the invention, is to provide an apparatus which does not require a main water supply and in which only the amount of water lost by natural evaporation has to be replenished.

Other advantages of the invention will become clear in the course of this description.

According to the present invention there is provided apparatus for use in processing photographic material including means for holding or supplying at least one aqueous processing liquid for contacting a photographic material during its movement through the apparatus, means for receiving used aqueous liquid from the photographic material, and means for heating such used liquid to bring about evaporation of water therefrom. Preferably the apparatus also includes means for bringing about condensation of steam resulting from such evaporation and for conducting the resulting condensate back to at least one said means for holding or supplying aqueous liquid, e.g. to means for holding or supplying washing or rinsing water.

The solid residue resulting from the evaporation of water in an apparatus according to the invention can be collected for treatment in a silver recovery plant. For example the said residue may be temporarily stored and eventually delivered to a silver refinery possessing the necessary installation for liberating silver metal from its compositions in an economic and ecologically clean way.

In preferred embodiments of the invention, the apparatus is constructed so that aqueous liquid(s) from the material being processed is or are caused continuously to flow through the heating means so that there is a continuous generation of steam and continuous discharge of solid residue which can be collected and treated for recovery of silver.

The heating of the used liquid(s) for evaporation of water therefrom is preferably insufficient to bring about decomposition of solid substances contained in such liquids.

The invention is of particular value when there is a plurality of processing stations at which different processing solutions are held or supplied, means for conducting photographic material through the processing stations in succession and means for continuously conducting used processing solutions through heating means whereby water is continuously evaporated.

Considerable advantage attaches to embodiments of the invention wherein receiving and heating means as aforesaid is provided for receiving and heating used washing or rinsing water coming from the photographic material on leaving a washing or rinsing station, and wherein there is means for condensing the evaporated washing or rinsing water and recycling it to the washing station. The invention includes apparatus wherein provision for receiving used liquid, evaporating water therefrom, and condensing and recycling the water is made only in respect of washing or rinsing liquid. Such an apparatus can be used without a main supply of fresh washing or rinsing water. Only a small quantity of reserve water is necessary for replacing natural evaporation losses. Preferably however, apparatus according to the invention has provision for receiving and evaporating not only contaminated washing or rinsing water which drains or is removed from the photographic material on leaving the washing or rinsing stations but also for receiving and evaporating used processing solution from at least one preceding processing station, preferably from at least a fixing station.

Apparatus according to the invention may comprise means for holding baths of the aqueous processing liquids used, and for conducting photographic material through these baths in succession. Preferably such apparatus, includes at least one pair of rollers for transporting the photographic material as it leaves each processing stage, and receiving means for receiving used solution which is squeezed off the photographic material by such rollers.

As an alternative, the processing stations or at least one of them may comprise means for applying, e.g., spraying, aqueous liquid onto the photographic material. In such apparatus used liquid to be passed through the heating means may likewise simply drain from the photographic material or be removed by rollers or other means.

In certain apparatus according to the invention, the apparatus comprises developing, fixing, rinsing and drying stations. In other embodiments of the invention, the apparatus comprises a developing station and a stabilising station at which unexposed and undeveloped silver salt(s) is or are converted to non-light-sensitive compound(s). Such a stabilising station may be followed by a normal fixing station but that is not essential. At the developing station of any given apparatus the processing solution used may be a solution of developer or, if the photographic material contains developing substances, an activating solution.

In any apparatus in which provision is made for receiving and heating used liquid from more than one station, there is preferably a single heating section, the quantities of used liquid from the different processing stations being combined and heated together in such section.

The mixing of used developing solution and used fixing solution normally results in a practically neutral composite mixture because the developer has alkaline properties whereas normally the fixer is acid in nature.

It is to be understood that the evaporation of the water may be brought about with the assistance of the application of a partial vacuum in order to lower the boiling temperature of the water.

As the concentration of the used processing solutions is relatively high, the evaporation of water can be accomplished by electrical heating means with moderated electrical energy consumption. The evaporated water may be used advantageously for heating a drying station or for the thermostatization of the processing stations. The condensed water may be recycled to the washing station or run to waste.

As it was recently discovered that the water quantity, necessary for rinsing the processed films may be drastically decreased, it is possible by using apparatus according to the invention to treat the wash water and to reuse it, so that it is only necessary to add a small quantity of fresh water to the washing station in order to compensate for the loss of water due natural evaporation.

Bearing this in mind, the apparatus according to the invention can be operated independently of a main water supply. It is an advantage to be able to process photographic material at places where no main water supply is present, as is often the case where industrial radiographs are taken. The invention can also be embodied with advantage in small apparatus, such as apparatus for microfilm processing.

Losses of water may be compensated for from inverted bottles working according to a kind of birds fountain principle or by using devices known in connection with small independent processing machines.

Figure 2:
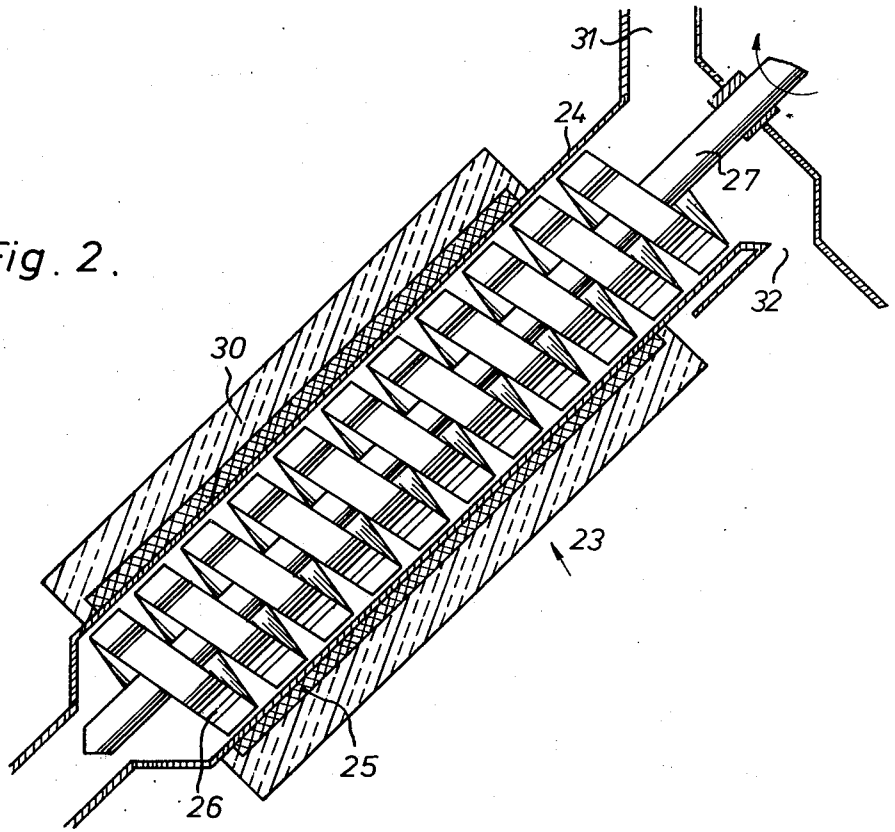
Figure 3:
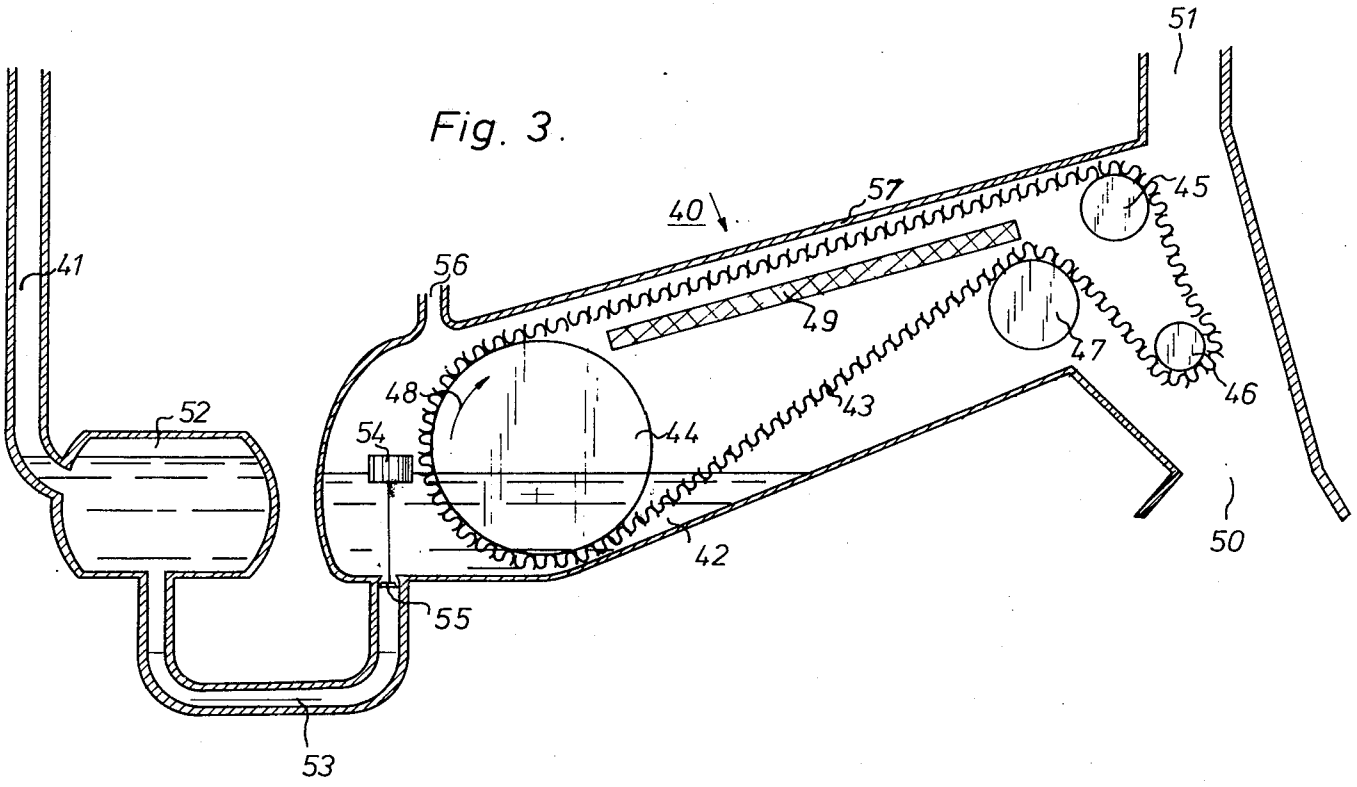
Figure 4:
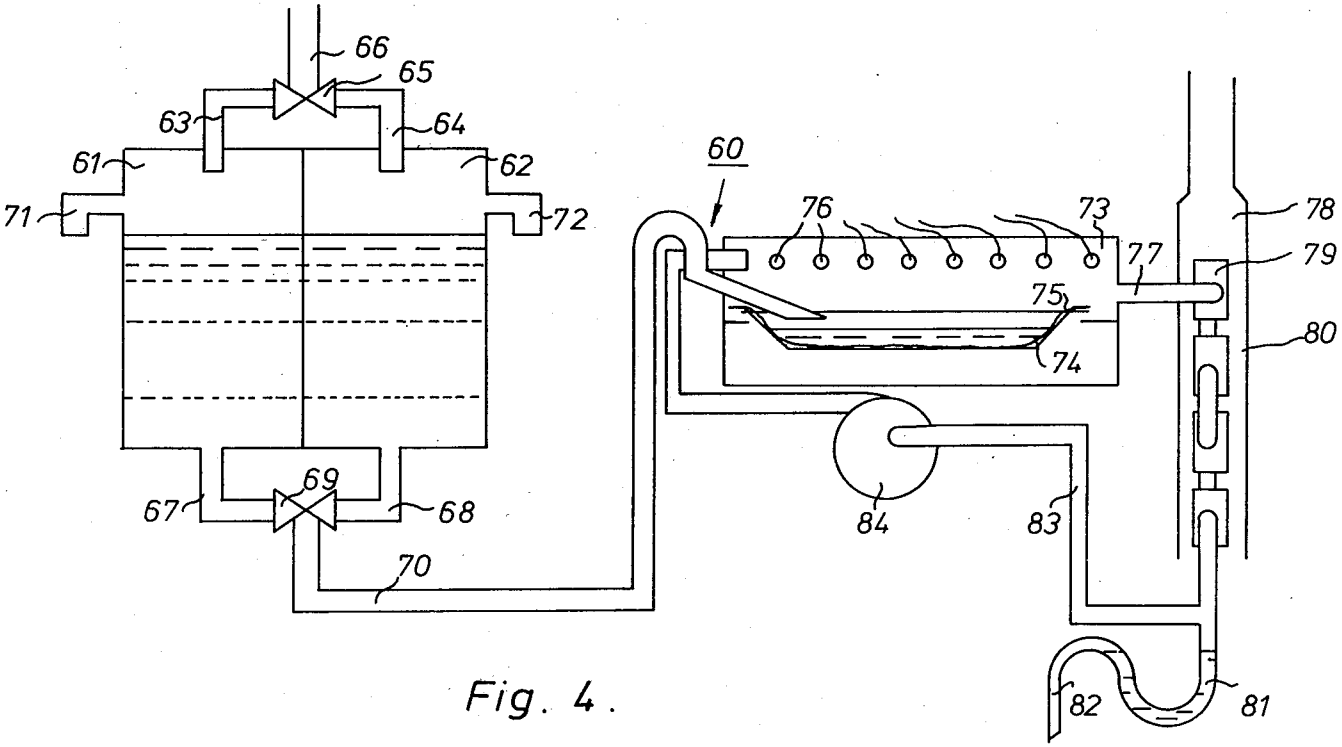

The scope and spirit of the invention may be more clearly understood in the light of the description of some preferred embodiments with reference to the following figures, in which:

FIG. 1 represents a cross-sectional view of a processing apparatus in which a device according to the invention is built-in, FIG. 2 shows a preferred embodiment of a device according to the invention, FIG. 3 shows another preferred embodiment of a device according to the invention, FIG. 4 shows another embodiment of an apparatus according to the invention.

In FIG. 1 a processing apparatus 10 is represented for continuously processing black-and-white sheet films for example X-ray films. It comprises four stations : the developing station 11, the fixing station 12, the washing station 13 and the drying station 14. Films are transported through the apparatus with the help of a roller system, comprising a plurality of driven roller pairs 15, the rollers being separated from each other through guide means 16. The drying station 14 is generally provided with a blower which directs heated air onto the film surface. These features, however, have not been represented in detail as they are sufficiently known in the art.

At the exit end of the processing apparatus 10 a small holder 17 for containing the processed films 18 is provided. Each station in which liquids are used is provided with overflows through which used liquids are evacuated. So, the developing station 11 has an overflow 19, the fixing station 12 is equipped with an overflow 20 and the excess of rinsing water of the washing station 13 is evacuated through the overflow 21, the latter being provided with an outlet 36 which in the case shown leads to the sewer. In case the quantity of wash water is kept very low, this outlet may be connected with conduit 22.

Contrary to the present, commonly used processing apparatus, the apparatus equipped with a device according to the invention collects the waste aqueous solutions for further treatment.

So, the exit of the overflows 19 and 20 of the developing station 11 and the fixing station 12 respectively are collected and directed through a common conduit 22 towards the device 23, which is shown more in detail in FIG. 2. Preferably, an element 52 is provided in order to keep the liquid to be treated at a constant level (see FIG. 3).

Said device 23 comprises a body 24 of circular section around which a heating element 25 is closely fitted in order to get an optimal heat transfer towards the inner space of the body 24. In the inner space, a kind of Archimedian screw 26 fitted on an axle 27 is provided, which is capable of rotating in such direction that an upward flow within the body is built-up. The rotation is imparted under the influence of motor 28, linked to the axle 27 by means of a Cardan type coupling 29. The device 23 is surrounded by a heat shielding 30 guaranteeing a minimal loss of heat.

The mixture of waste processing liquid enters the device 23 through inlet opening 30*a*, where its heating by the heating element 25 is started. Said element is preferably an electrical wire resistance element, although other means for heating, well known in the art may be used advantageously. During heating the temperature within the body gradually rises. Preferably, the temperature is kept lower than 130° C, but higher than 100° C when working at normal atmospheric conditions.

The reasons why this temperature range is kept between relatively narrow limits at normal atmospheric conditions is governed by the facts that on the one hand the water must be allowed to evaporate completely in order to leave a solid residue, but that on the other hand decomposition of some products, for example sodium thiosulphate, normally present in fixing solutions, occurs already in the vicinity of 130° C and might give rise to the formation of poisonous gases.

The body 24, and the screw 26 may be made of stainless steel, or other material, even polymeric material, capable of resisting the corrosive action of some chemical substances at high temperatures. The device is mounted in inclined position, although the angle of inclination is not critical. When the angle was varied between 5 and 45 degrees the device remained in good working condition.

The device 23 is provided with openings 31 and 32 at its exit end. Through opening 31 steam may escape, whereas through opening 32 the solid residue is forwarded to a collecting vessel 33. This residue in which the dried chemicals of the waste aqueous solutions are present is rich in silver salts which were contained in the used fixing bath. The residue may be periodically sent to silver refineries which, in an economic way, may separate the silver from the rest without danger of pollution. The steam escaping through opening 31, may either be condensed and fed to a sewer, in the form of practically distilled water, or may be recycled into the machine so reducing the amount of main water necessary for processing.

To this end, the steam is first condensed in the drying station 14 by means of a heat exchanger, comprising tubes 34 onto which ribs 35 are provided. In so doing the heat set free during the condensing cycle is advantageously used because the air being warmed-up may be guided to the films to be dried with the help of a blower (not shown). The gradual decrease of the temperature of the steam causes same to condense. After complete condensing, the distilled water obtained may be forwarded to a sewer opening valve 39 or again forced through conduit 37 into the washing tank when opening valve 38, so contributing to an economy of wash water. Occasionally, the condensing or condensed water may be forwarded through the processing stations for warming up and/or thermostatizing the corresponding solutions.

The relatively small dimensions of the device according to the invention make it possible to incorporate the latter in practically any processing apparatus actually available on the market.

Another device according to the invention is shown in FIG. 3.

In this case, a mixture of waste processing solution is fed through pipe 41 to a collecting vessel 52, prior to being supplied to the apparatus 40. The purpose is to obtain a practically constant level in apparatus 40. To this end the liquid is supplied via an automatic valve 55, which opens when the level of the liquid has fallen beneath a valve determined by the length of a small rod fixedly connected to the valve 55 and a float 54. The liquid is then collected in a trough 42 connected to the collecting vessel 52 by means of a tube 53. In the trough 42, an endless belt 43 is guided, which is tensioned by and runs over a plurality of rollers, in this case rollers 44, 45, 46 and 47.

The endless belt 43 is preferably made of a water-absorbent fibrous material, which is capable of resisting the corrosiveness of products currently used in the fixing baths.

When rotating roller 44 turns in a direction denoted by the arrow 48, the belt 43 becomes soaked with used processing liquid, the water of which evaporates when passing over heating element 49, the latter being heated between 100 ° and 130° C in normal atmospheric conditions. By applying a vacuum in the interior of the apparatus 40, the boiling point of the water may even be drastically reduced. In this case, a vacuum is applied via the opening 56, which may for example be connected with a water jet pump (not shown). When reaching the upper limit of its course, the belt is guided over rollers 45 and 46, the latter being of smaller diameter. This causes the dried residue to fall off the belt and to leave the device through the exit opening 50, whereas in the same time steam escapes through opening 51 and is carried off for further treatment as explained in the description of the device shown in FIG. 2.

The apparatus is air-tightly closed by a casing 57, enabling it to be securely built-in into existing processing apparatus due to its relatively small dimensions.

In the foregoing, the method of recovering solid substances from a solution was decribed in connection with a continuously operating processing machine. For small processing laboratories where scale development is still applied, scales with waste processing solutions may be placed in a stove and heated in the range between the boiling point of water and the decomposition temperature of the solids present in the processing solutions. Occasionally a pump may be installed for pumping the waste liquids from a collector. The scales may occasionally be placed in cascade. Also a partial vacuum may be applied, so that moderate temeratures may be applied.

In FIG. 4 is shown another embodiment of an apparatus according to the invention and in which use is made of the heat emitted by sources of infra-red radiation, in order to evaporate the water of the waste solutions. Contrary to the embodiments shown in the preceding figures, the working of the apparauts is discontinuous, but its advantage lies in a high degree of reliability due to its simple construction.

Said apparatus 60 comprises two collecting tanks 61 and 62 to which waste solutions may be fed via inlet pipes 63 and 64, connected to the overflow conduit 66 of the processing machine (not shown). A three-way-valve 65 is built-in into the overflow conduit 66, connecting the latter with the collecting tanks 61 and 62. The collecting tanks 61 and 62 may be provided, if desired, with overflows 71 and 72. At the outlet of the collecting tanks 61 and 62 a more or less symmetrical configuration of conduits is provided, connecting said collecting tanks with the evaporator unit 73. So are provided the outlet conduits 67 and 68, connected to the collecting tanks 61 and 62 respectively, which feed waste solution to be evaporated to conduit 70, the latter being connected to the evaporator unit 73. Here too, a three-way-valve 69 is provided for the switching from the collecting tank 61 or 62 to the conduit 70.

It will be appreciated that during operation of the apparatus 60 one collecting tank will be connected to its corresponding supply conduit, while the other is connected to the evaporator unit 73.

The evaporator unit 73 is in the form of a box, the lower part of it containing a container 74 into which the waste solution supplied by the conduit 70 flows. The container itself is firstly provided with a kind of water impermeable bag liner 75 for easy removal of dry substances after evaporation. In the upper part of the evaporator unit 73 a plurality of heat radiators 76 are provided which project heat towards the surface of the waste solution contained in the container 74. Said heat radiators 76 are only diagrammatically represented, but every known means capable to emit radiation for making water evaporate may be used for the purpose. Successful attempts were made as well with infrared radiators as with micro-wave generators. It is clear that in the last case the energy supply lines must be carried out with either coaxial cable as with wave guides and that the necessary precautions have to be taken for keeping the emitted radiation within the space defined by the evaporator unit 73 itself. This may be done, for example, by suitable screening means. The cover of the evaporator unit 73 may be provided at the inside with a layer of heat reflective material. Upon evaporation the vapour is guided through conduit 77 towards a condensing unit 78, comprising a condensor 79 around which a mantle 80 is provided. In the space defined by both bodies, an air flow is built up by suitable means (not shown) causing the vapour to condense. The water so obtained may be fed to a sewer or recycled in the processing machine as rinsing water via conduit 82. Between the outlet of the condensor 79 and the conduit 82 a waterseal 81 may be provided, if desired. During evaporation a continuous flow of air is maintained in the circuit so that the formed vapour is continuously withdrawn from above the surface of the waste liquid to be treated and the radiant energy may be applied with optimum yield. To this end a fan 84 and its associated conduits are provided between the outlet of the condensor 79 and the upper part of the evaporator unit 73.

It may be concluded from the preceding description that every metal for example, cadmium which is washed out of the photographic material during the processing, may also be recovered advantageously.

From the foregoing, it may be derived that new and useful apparatus have been devised which are suited to be positively engaged in the problems of environmental protection. Although the description of a pair of preferred embodiments was directed to the use of the device in combination with high running fully automatic processing machines, also small installations may be advantageously equipped with it. So, small-sized apparatus, for example microfilm processors used in libraries or processors for industrial X-ray films used on the spot may be equipped with the device, whereby the total amount of used liquids, including the wash water, passes through it. In that case only a little amount of water must be put into the washing tank in order to compensate for the natural evaporation. This can easily be done with the help of an inverted supply bottle so that the apparatus becomes completely independent of a main water supply.

As the foregoing has only served to describe a pair of preferred embodiments of the invention, the scope and spirit of the latter shall be derived from the appended claims.

We claim:

1. An apparatus for processing photographic material, comprising: at least one processing station for applying aqueous processing solution to said material and producing used processing solution containing solid material and at least one drying station for drying the material — means located in said at least one processing station for collecting the used processing solution, — means to heat said used solution above its boiling point but beneath the decomposition temperature of the solid material contained therein to evaporate said solution and form a solid material residue, — means associated with said material drying station for condensing the steam generated by said heating means and using the heat set free during such condensation in said drying station for drying the processed photographic material, — means for collecting the solid residue from said heating means, and — means for collecting the water formed by such condensation of the steam.

2. An apparatus according to claim 1, in which said at least one processing station is a water rinsing station and means is provided to re-cycle the water resulting from said condensation to said rinsing station.

3. An apparatus according to claim 1, which further comprises means for collecting the used aqueous solution from a plurality of processing stations to form a composite mixture to be evaporated.

4. An apparatus according to claim 1, in which means are provided for creating a partial vacuum in said heating means.

5. An apparatus according to claim 1, in which said means to heat said used aqueous solution is in the form of a hollow cylindrical longitudinally extending body provided in its interior with screw means for axially moving the used aqueous solution, heating means extending axially along the outer periphery of said body, an inlet opening through which said used aqueous solution is introduced into said body, a first opening through which steam resulting from heating escapes, and a second opening through which solid residue is collected.

6. An apparatus according to claim 5, in which the hollow cylindrical longitudinally extending body is mounted at an inclined position.

7. An apparatus according to claim 1, in which said means to heat said used aqueous solution is in the form of a porous, continuously moving belt, driven at uniform speed along an endless path over a plurality of rollers, at least one of said rollers being partly immersed in a trough in which said used aqueous solution is collected, the remaining rollers leading the belt out of said trough over a heating element coinciding with the path of said belt to a first exit opening through which steam resulting from heating escapes and to a second exit opening through which solid residue is collected, said latter opening being situated at a position where the belt performs a sharp curvature.

8. An apparatus according to claim 1, in which said means to heat said used aqueous solution is in the form of a box-like body, said box-like body containing a container in which said aqueous solution is collected and heat radiating means located above said container in order to transfer heat from said heat radiating means towards said solution.

9. An apparatus according to claim 8, in which said heat radiating means is in the form of a plurality of infrared heat radiators.

10. An apparatus according to claim 8, including fan means for providing a continuous flow of air over said solution.

11. An apparatus according to claim 1, in which said means to collect the solid residue resulting from heating comprises a container lined with a water-impermeable bag to facilitate removal of the solid residue.

* * * * *